US006511198B1

(12) United States Patent
Erickson

(10) Patent No.: US 6,511,198 B1
(45) Date of Patent: Jan. 28, 2003

(54) WEARABLE DISPLAY

(75) Inventor: Michael D Erickson, Ft Collins, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/470,942

(22) Filed: Dec. 22, 1999

(51) Int. Cl.[7] ..... F21V 21/08; H01J 1/62; H01J 63/04

(52) U.S. Cl. ..... 362/103; 362/84; 362/85; 313/510

(58) Field of Search ..... 362/103, 84; 313/498, 313/511, 510, 512

(56) References Cited

U.S. PATENT DOCUMENTS 4,999,936 A * 3/1991 Calamia et al. ..... 40/544
5,469,020 A * 11/1995 Herrick ..... 313/511
5,546,413 A * 8/1996 Lebby et al. ..... 372/6
5,552,679 A * 9/1996 Murasko ..... 315/169.3
5,705,888 A * 1/1998 Staring et al. ..... 313/503
5,856,030 A * 1/1999 Burrows ..... 428/690
5,971,557 A * 10/1999 Kubes et al. ..... 362/24
5,977,718 A * 11/1999 Christensen ..... 315/169.1
6,084,526 A * 7/2000 Blotky et al. ..... 340/691.6
6,116,745 A * 9/2000 Yei ..... 362/105
2001/0043164 A1 * 11/2001 Thagard et al. ..... 345/7

* cited by examiner

*Primary Examiner*—Sandra O'Shea
*Assistant Examiner*—Ali Alavi

(57) ABSTRACT

The present invention pertains to the provision of Light Emitting Polymer structure, which increases the versatility of the coloring and marking of surface areas of manufactured items, particularly fabric and garments.

24 Claims, 1 Drawing Sheet

WEARABLE DISPLAY

TECHNICAL FIELD

This application relates in general to light emitting polymer displays, and in specific to light emitting polymers used as wearable displays.

BACKGROUND

Prior art attempts at providing surface areas with patterns, decorations, colors, advertisements, information, and the like onto all manner of surfaces have been generally confined to printing (paint, transfer process, etc.) or integration (weaving and/or coloring raw batches of composite materials, etc.). In accordance with these methodologies, the prior art teaches the marking, coloring, or printing of walls, fabrics, plastics, metals, infrastructures, and other manners of manufactured items. However, all of the above prior art methodologies are subject to the same inflexibility. Specifically, once a surface of any one of the multitude of disparate objects is prepared with colors, patterns, or markings, any changes required thereon may range from the impossible (such as in the case of fabrics, where color is dyed on or woven in), to the time consuming (such as repainting walls, metals, or transportation infrastructures, such as roadway markings, etc.)

Accordingly, the prior art technology relating to the field of surface area marking has certain drawbacks. Recent attempts to overcome the particular disadvantages of the prior art, such as the ones described above, include a wide range of solutions, ranging from the use of light emitting diode (LED) screens on changeable surfaces (e.g., highway signs reflecting the updating of highway information) to items such as reversible jackets or velcro patches, which are offered as a remedy to the inflexibility of the coloring or marking of textiles or fabric. Nevertheless, such solutions provide at best only moderate flexibility with respect to the ability to change the surface colorings or markings, particularly with respect to non-paintable, flexible surfaces such as fabric. Moreover, the prior art teachings have yet to offer a solution which is widely applicable to all manner of surface changeability, including flexible surfaces like fabric.

Therefore, there is a need in the art of surface area marking for a system that permits easy changeability of surface coloration or marking across the wide range of materials having markable surfaces. Furthermore, there is a particular need for such a solution to apply to surfaces which are flexible and not easily changeable, such as fabric.

SUMMARY OF THE INVENTION

These and other objects, features and technical advantages are achieved by a system and method by which light emitting polymers (LEPs) are applied to a variety of surfaces, both flexible and inflexible, in order to provide versatile, easily changeable surface markings and/or coloration. A system and method are disclosed which further provide for displaying both still and moving images (e.g., movies) on such surface. Additionally, other information received/generated by an application may be displayed on such surface. For example, a received e-mail or a desired map generated by a mapping application may be displayed on the surface. In a most preferred embodiment, the surface on which the LEPs are utilized to display a desired image/color/information is a fabric surface. For instance, in a most preferred embodiment, LEPs are implemented within an article of clothing that a user may wear.

Specifically, LEPs are a class of polymers which exhibit electrical properties beyond the purely insulating characteristics of simple plastics and provide a light weight combined with physical strength, yet are able to offer structural flexibility in the areas of application/manufacture, as well as versatility in usage thereafter. More specifically, LEPs are conjugated polymers which may be molded, extruded woven, deposited (e.g., through electrochemical or spin coating means) or even may be printed on a surface, all while providing metallic and semiconductor characteristics. These characteristics stem from the very structure of the class of polymers which possess a delocalized pi-electron system along the polymer backbone such that the delocalized pi-electron system. This confers semiconducting properties to the polymer and gives it the ability to support positive and negative charge carriers. It is the nature of the characteristics described as such which offer materials fashioned thereof with many classical transistor-like properties.

Accordingly, LEPs are generally suitable to application of a variety of surface areas in neo-transistor structural order. Application in certain structural order may be fashioned even on difficult surfaces, such as fabrics, which ideally would have flexible substrate surfaces, and are then spun coated from LEP material, into distinct layers. In a preferred embodiment, the composition of these layers would ideally be doped semiconducting conjugated polymers such as polyaniline and polypyrrole which lead to the presence of states in the band gap, and at sufficient dopant concentrations, permit the band gap to virtually disappear, thereby allowing the polymer to act as a metal with high conductivity. Although, any suitable composition now known or later developed may be implemented, and any such implementation is intended to be within the scope of the present invention. For instance, any suitable composition for a sufficiently flexible LEP display that may be implemented with fabric, such as an article of clothing, is intended to be within the scope of the present invention.

By providing material composed of the LEP elements of a preferred embodiment, versatile, flexible fabrics are provided which would permit a user to change the color, pattern, or design of a garment, for example, constructed of such fabric. For instance, the mere touch of a control button may dictate transmission of coloration or markings in say, an array of transition-like modules, which, according to embedded code (as known in the art of video display coding) may implement, pixel by pixel, the resulting appearance throughout the specified areas in a garment. Structured as such, a preferred embodiment of the present invention contemplates provision of a given wearer of a LEP garment the ability to change the appearance of an article of clothing, such as a jacket. For example, in a preferred embodiment, a user may change a jacket from bearing the design of the New York Yankees to that of the logo of the New York Giants, or alternatively, to change the color, text, or other pattern on any given garment. Furthermore, in a preferred embodiment, the display on a garment need not be still images. For example, movies, videos, cartoons, "screen savers," or any other type of moving images may be displayed on the fabric.

Furthermore, provision of LEPs in such a manner extends well beyond garments. As examples, the contemplated provision of flexibly-backed LEP elements also provides for application to walls, signs, carpets, road surfaces, automobile surfaces (interior and/or exterior), airplane surfaces (interior and/or exterior), safety devices, message boards, etcetera. Of course, it will be recognized that flexibly-backed LEPs as disclosed herein may be utilized in an unlimited number of applications, and the scope of the present invention is intended to encompass all such applications. Such surfaces may simply be augmented by the covering of desired surfaces with the described flexibly-backed LEP material or may even be originally provided with the above-described LEP elements spin coated or otherwise deposited on a given manufactured surface area. For example, a surface may be implemented as a movie screen to display a movie, as opposed to a movie projector being utilized to project a movie onto the display surface. Thus, the requirement of expensive movie projector equipment for displaying movies may be eliminated.

Accordingly, it is a technical advantage of the present invention to provide versatility and ease of LEPs for changing surface coloration and marking. It is a further technical advantage of the present invention to apply the advantages of LEPs to problematic surfaces such as fabric, such that a user would be able to increase the versatility and appearance of any given fabric, such as a garment.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken on conjunction with the accompanying drawing, in which.

DETAILED DESCRIPTION

For ease of explanation, the below description focuses primarily on a preferred embodiment for implementing LEPs to accomplish a fabric (e.g., a wearable) display. However, the below description of a preferred embodiment is intended to render the disclosure enabling for many other applications of such LEPs (e.g., utilizing LEPs with any other type of flexible surface), which are intended to be within the scope of the present invention. It should also be understood that a preferred technique for implementing such an LEP is disclosed below to render the disclosure enabling and satisfy the best mode requirement, although other techniques that are now known or later developed may be utilized in implementing such an LEP on a flexible surface such as fabric, and any such implementation is intended to be within the scope of the present invention.

The actual thickness of the LEP elements are principally determined by the particular embodiment required for appearance purposes. Thus, by way of example, in the case of an article of clothing or garment which has a changeable surface area for providing a video, map, or variable team logo display, an active matrix display of LEPs would be optimal. Such an embodiment would ideally be provided with a spin coating deposition of an approximately 1000 Å layer having hole mobilities of between 0.1 and 1 $cm^2 V^{-1} s^{-1}$ with fields of 5 or $10^5$ v/cm in order to achieve needed switching speeds. The preferred material will be PPV, which might have intrinsic conductivities on the order of $10_{-12}$ $(Ohm\ cm)^{-1}$. More specifically, the use of polypyrrole and polyaniline is expressly contemplated for a preferred embodiment given their relatively superior stability. However, the particular use of one or the other is dependent on the processing for the given application. Generally, polypyrrole is not directly processable and is deposited in film form by electrochemical means, while polyaniline is generally made soluble through the use of soluble counter-ions that associate with the dopant ions on the polymer backbone, all of which provide conductivity levels between $10^{-2}$ and $10^2$ $(Ohm\ cm)^{-1}$.

Figure 1:
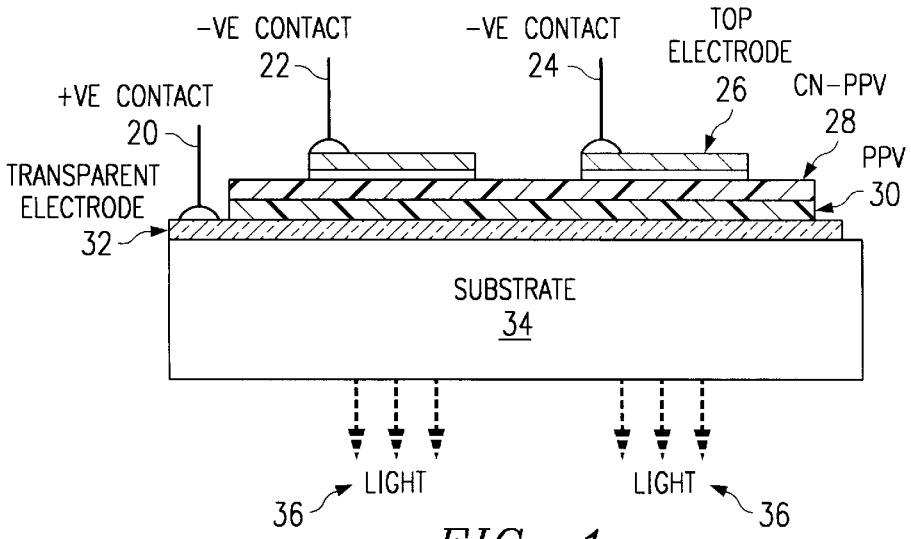
FIG. 1 depicts a cross section of a preferred embodiment of LEP layers deposited on a flexible substrate.

Turning attention to FIG. 1, shown is a cross section depiction of the layered deposition of LEP materials on a flexible substrate 34 of a preferred embodiment. As mentioned, the application of the contemplated conjugated polymers is structured in order to provide a configuration which utilizes transistor-type principles the novel medium of a flexible substrate coated with the particular advantages of the below-described non-metallic materials.

In particular, a preferred embodiment of the present invention contemplates use of a heterostructure that allows carrier confinement at the polymer/polymer interface in order to increase the likelihood of electron/hole capture so as to form an exciton that can radiatively recombine. In a most preferred embodiment, the electron/hole injection barriers will be similar through the provision of an injection electrode material and through the modification of the polymer material to be electron withdrawing so as to provide for a higher or lower electron affinity. More specifically, a preferred embodiment provides for a cyano group which is electron withdrawing and is capable of pushing down the barrier to electron injection. Accordingly, cyanoPPV (CN-PPV) layer 28 therefore acts as an electron transport layer. Because the bandgap of the CN-PPV layer 28 is lower than the PPV layer 30, recombination takes place in this layer thereby increasing efficiency at ranges of over 1%.

Because heterostructures can be designed using polymer material and given that organic synthesis allows additional degrees of freedom in tuning bandgap and work function of semiconductors, the polymer materials of a preferred embodiment are capable of a performance level comparable with inorganic LEDs and further have the fast switching speeds typical of LEDs. LEPs further provide the added capabilities of large area patterning at low cost because the light emitting device can be patterned simply by pixellation of the metal (unlike inorganic LEDs which require a highly doped semiconductor layer for ohmic contact). Hence, large area pixilated displays made from one sheet are possible, with added features such as flexibility. Preferred embodiments include their use as backlights for instrumentation panels or for ultra-thin transflective LCDs fixed on flexible garments. However, in an especially preferred embodiment, the system will comprise the use of simple patterning, such as dot matrix alphanumeric displays.

Specifically, the configuration of a preferred embodiment of an efficient light emitting structure on a flexible background for use on textiles and other manufactured items is as follows (with continued reference to FIG. 1): (1) flexible substrate layer 34, which may be a plastic flexible layer (preferably a polymer) which allows passage of light 36; (2) a transparent electrode layer 32; (3) PPV layer 30; (4) CN-PPV layer 28; and (5) a bit size electrode 26, which contains –ve contacts 22, 24 which are opposed to +ve contact 20 located on transparent electrode 32. Thusly provided for, a preferred embodiment of the present invention affords greater versatility in changing the coloration or marking of surface areas, while providing the versatility of a flexible substrate which permits the resulting array of LEP units to be draped or contoured to a multitude of surfaces as needed.

Figure 2:
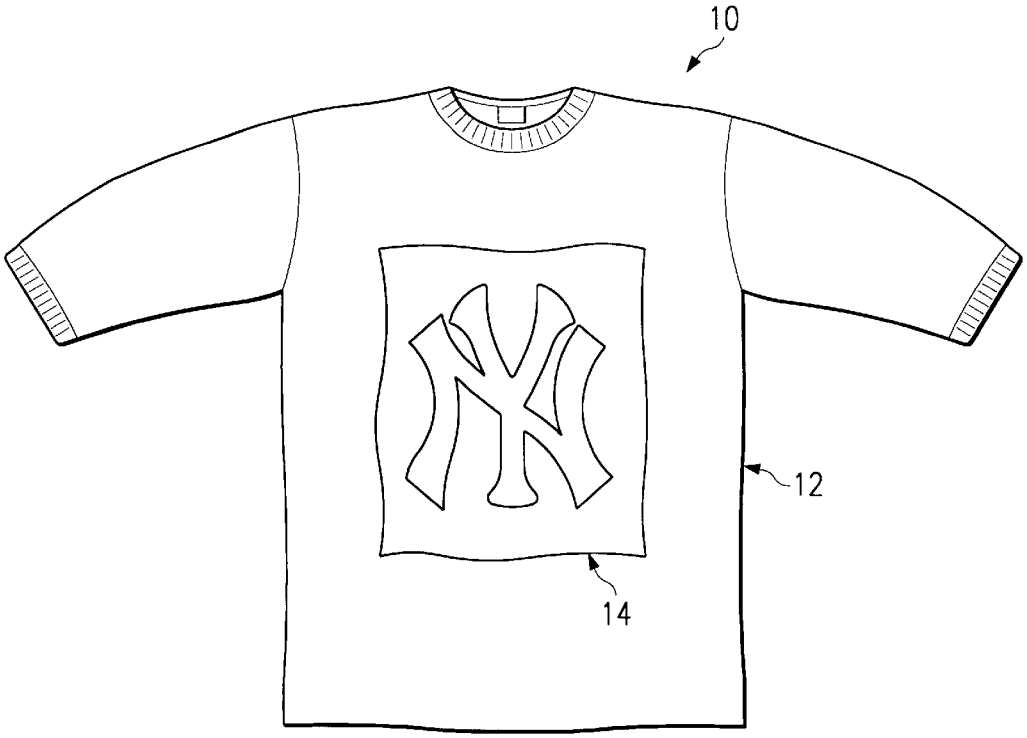
FIG. 2 depicts a preferred embodiment garment fashioned from a fabric having a changeable surface area.

Although the present invention also contemplates the use of the described array and structure in environments where flexibility is not required, a preferred embodiment, as depicted in FIG. 2, includes application as a fabric which may be fashioned into garments which will provide for the uses described herein. For example, an array of LEP units 14 may be provided on a jacket. As shown, the LEP display 14 may display a particular image, such as the New York Yankees logo. However, according to a preferred embodiment of the present invention, a user may change the display to a different color and/or different logo. For instance, a user may change the display 14 to a logo for the St. Louis Cardinals. As a further example, display 14 may provide "New York Yankees—World Champions 1998." A user may alter the display 14 to read "New York Yankees—World Champions 1999." Thus, a user may alter the display 14 to allow the jacket to be more versatile and to remain up to date with changing fashion and/or changing information.

In a preferred embodiment, the jacket may include a power supply 10 (e.g., batteries, such as Ni—MH batteries), which may be integrated within the shoulder pad, for example, of a jacket. Of course, various power supplies may be implemented, and such power supplies may be arranged in any desirable manner for a particular application of a preferred embodiment. Additionally, in a preferred embodiment, a control system 12 (e.g., a computer) may be provided to allow a user to control display 14. Control system 12 may vary with complexity, depending on the amount of control/versatility desired and the requirements for integrating such a control system within a particular application (e.g., the size requirements). For instance, a control system 12 may be integrated within a pocket of the jacket, so as to be inconspicuous. Control system 12 may include one or more buttons, which when activated may alter the display 14. For example, depressing such a button(s) may scroll the display 14 through images/colors pre-stored within the control system 12. Of course, control system 12 may, in various embodiments, include any amount of functionality for allowing a user to interact with such control system. For example, in some embodiments, a partial or full keyboard may be provided for control system 12 to allow a user to interact with the control system 12 (e.g., to edit/change a display 14). Additionally, the on-board control system 12 may include a connector that allows the control system 12 to be coupled to an off-board system (e.g., a PC), whereby a user may utilize such an off-board system to control display 14. For example, a user may couple the control system 12 of a jacket to a PC (e.g., via a serial port or USB port) and then edit/change the display 14, as desired, utilizing the PC's input devices (e.g., keyboard, mouse, etc.).

Various applications may be executed by control system 12 to display information on a display 14. For example, a mapping application may be executing to allow a map to be displayed on a wearable display 14. For instance, a user may utilize a mapping application to map out the directions for a desired destination, and the directions may be displayed on display 14 to aid the user in navigating to the desired destination. In one embodiment, control system 12 may provide a mechanism (e.g., a button) which when activated displays the map (or other desired information) on display 14, and the control system 12 may provide a further mechanism (e.g., the same or different button) which when activated displays another image on display 14. Thus, the user may alternate display 14 between a New York Yankees logo, for example, and a map illustrating directions to a desired location. Thus, when the user arrives at the desired location, he may simply choose to have the New York Yankees logo displayed.

As another example, a wrist band or other article of clothing may include a display 14, and control system 12 may allow a user to store reference information to be displayed on display 14. For instance, a quarterback of a football team may store various formations and plays within control system 12 and recall such information on the display 14 during a game. Alternatively, a user may store an outline and/or notes for a presentation, and the user may display such outline and/or notes for reference when giving the presentation. Of course a user may store various other reference information, including but not limited to shopping lists, to-do lists, or other information that may be displayed on display 14. As a further application, in one embodiment control system 12 may allow a user to receive a message (e.g., an e-mail and/or page) via control system 12 and display the received message on display 14.

It should be understood that in a most preferred embodiment, LEPs are implemented on an article of clothing, including but not limited to shirts, ties, jackets, coats, pants, shorts, underwear, socks, shoes, dresses, blouses, skirts, gloves, scarfs, wrist bands, head bands, and hats/caps. However, it should be understood that a preferred embodiment may be implemented for any fabric, not just an article of clothing. As examples, fabric for furniture, carpet, rugs, drapes, curtains, towels, sheets, blankets, other linens, pillows, and/or other fabric commonly found in a room may be so implemented to allow for versatile interior designing. As yet a further example, handbags, purses, briefcases, luggage, golf bags, bowling ball bags, and gym bags may be implemented having LEPs.

It should also be understood that a preferred embodiment of the present invention may be implemented using the technique described above, with reference to FIG. 1. However, alternative embodiments may be implemented using any other now known or later discovered technique for implementing LEPs on a flexible surface (e.g., fabric), and the scope of the present invention is intended to encompass any such implementation.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus for increasing the versatility of markings on surface areas of manufactured items, comprising:

a flexible substrate layer attached to a flexible surface area of a manufactured item; and an array of Light Emitting Polymer Units distributed on said flexible substrate layer to display at least one image of a plurality of images.

2. The apparatus of claim 1, wherein said Light Emitting Polymer Units have a structure comprising:

a transparent electrode layer formed on said flexible substrate layer;

a PPV layer formed on said transparent electrode layer;

a cyanoPPV layer formed on said PPV layer; and at least one bit size electrode formed on said cyanoPPV layer.

3. The apparatus of claim 2, wherein said surface area of said manufactured item is selected from the group consisting of fabric and leather.

4. The apparatus of claim 2, wherein said manufactured item is selected from the group consisting of a shirt, a tie, a jacket, a coat, pants, shorts, underwear, a sock, a shoe, a dress, a blouse, a skirt, a glove, a scarf, a wrist band, a head band, a hat, a cap, any other article of clothing, furniture, carpet, a rug, a drape, a curtain, a towel, a sheet, a blanket, linens, a pillow, any other fabric commonly found in a room, a handbag, a purse, a briefcase, luggage, a golf bag, a bowling ball bag, and a gym bag.

5. The apparatus of claim 1, further comprising a power supply for powering said array of Light Emitting Polymer units.

6. The apparatus of claim 1, further comprising a control unit for controlling said array of Light Emitting Polymer units, wherein the control unit controls the Light Emitting Polymer units to display said at least one image of a plurality of images.

7. The apparatus of claim 6, wherein each image is selected from the group consisting of:

a still image, a moving image, a video, a movie, a cartoon, a screen saver, a color, and information.

8. A method for increasing the versatility of markings on surface areas of manufactured items, comprising:

forming a flexible substrate layer;

forming an array of Light Emitting Polymer units on said flexible substrate layer;

attaching the flexible substrate with the array to a flexible surface area of a manufactured item; and displaying at least one image of a plurality of images using said array of Light Emitting Polymer units.

9. The method of claim 1, wherein said surface area of said manufactured item is selected from the group consisting of fabric and leather.

10. The method of claim 1, wherein said manufactured item is selected from the group consisting of a shirt, a tie, a jacket, a coat, pants, shorts, underwear, a sock, a shoe, a dress, a blouse, a skirt, a glove, a scarf, a wrist band, a head band, a hat, a cap, any other article of clothing, furniture, carpet, a rug, a drape, a curtain, a towel, a sheet, a blanket, linens, a pillow, any other fabric commonly found in a room, a handbag, a purse, a briefcase, luggage, a golf bag, a bowling ball bag, and a gym bag.

11. The method of claim 8, further comprising:

selecting said at least one image of a plurality of images to be displayed by said array of Light Emitting Polymer units; and controlling said array of Light Emitting Polymer units to form said selected one image.

12. The method of claim 11, wherein each said selected one image is selected from the group consisting of: a still image, a moving image, a video, a movie, a cartoon, a screen saver, a color, and information.

13. The method of claim 12, wherein said information is selected from the group consisting of: a received message, reference information stored by a user, and information generated by an application program.

14. An article having a versatile display comprising:

a manufactured item having a flexible surface;

an array of Light Emitting Polymer units having a flexible substrate layer, wherein the array is affixed to said flexible surface of said manufactured item in a manner that substantially maintains the flexibility of said flexible surface of said manufactured item; and a control unit for controlling said array of Light Emitting Polymer units, wherein the control unit controls the Light Emitting Polymer units to display at least one image of a plurality of images.

15. An apparatus for increasing the versatility of markings on flexible surface areas of manufactured items, comprising:

a flexible substrate layer attached to a flexible surface area of a manufactured item; and an array of Light Emitting Polymer Units distributed on said flexible substrate layer to display at least one image of a plurality of images, said array affixed to said flexible surface in a manner that substantially maintains the flexibility of said flexible surface.

16. A method for increasing the versatility of markings on flexible surface areas of manufactured items, comprising:

forming a flexible substrate layer;

forming an array of Light Emitting Polymer units on said flexible substrate layer;

attaching the flexible substrate with the array to a flexible surface area of a manufactured item such that the flexibility of the flexible surface is substantially maintained; and displaying at least one image of a plurality of images using said array of Light Emitting Polymer units.

17. The article of claim 14, wherein said flexible surface is selected from the group consisting of fabric and leather.

18. The article of claim 14, wherein said article is selected from the group consisting of a shirt, a tie, a jacket, a coat, pants, shorts, underwear, a sock, a shoe, a dress, a blouse, a skirt, a glove, a scarf, a wrist band, a head band, a hat, a cap, any other article of clothing, furniture, carpet, a rug, a drape, a curtain, a towel, a sheet, a blanket, linens, a pillow, any other fabric commonly found in a room, a handbag, a purse, a briefcase, luggage, a golf bag, a bowling ball bag, and a gym bag.

19. The article of claim 14, further comprising a power supply for powering said array.

20. The article of claim 14, wherein each Light Emitting Polymer Unit of said array have a structure comprising:

a transparent electrode layer formed on said flexible substrate layer;

a PPV layer formed on said transparent electrode layer;

a cyanoPPV layer formed on said PPV layer; and at least one bit size electrode formed on said cyanoPPV layer.

21. The article of claim 14, wherein each image is selected from the group consisting of:

a still image, a moving image, a video, a movie, a cartoon, a screen saver, a color, and information.

22. The apparatus of claim 7, wherein said information is selected from the group consisting of: a received message, reference information stored by a user, and information generated by an application program.

23. The article of claim 21, wherein said information is selected from the group consisting of: a received message, reference information stored by a user, and information generated by an application program.

24. The method of claim 8, wherein the step of forming an array of Light Emitting Polymer Units comprises:

forming a transparent electrode layer on said flexible substrate layer;

forming a PPV layer on said transparent electrode layer;

forming a cyanoPPV layer on said PPV layer; and forming at least one bit size electrode on said cyanoPPV layer.

* * * * *

UNITED STATES PATENT AND TRADEMARK OFFICE

CERTIFICATE OF CORRECTION

PATENT NO. : 6,511,198 B1
DATED : January 28, 2003
INVENTOR(S) : Erickson

It is certified that error appears in the above-identified patent and that said Letters Patent is hereby corrected as shown below:

Column 2,
Line 23, delete “spun” and insert therefor -- spin --

Column 7,
Lines 18 and 21, delete “claim 2” and insert therefor -- claim 6 --
Lines 52 and 55, delete “claim 1” and insert therefor -- claim 11 --

Signed and Sealed this

Twenty-sixth Day of July, 2005

JON W. DUDAS
*Director of the United States Patent and Trademark Office*